US007478514B2

(12) United States Patent
Wenz

(10) Patent No.: US 7,478,514 B2
(45) Date of Patent: Jan. 20, 2009

(54) SHIPPING CONTAINER PACKING METHOD USING SHRINK WRAP

(75) Inventor: Steven Wenz, Tallman, NY (US)

(73) Assignee: Pearson Education, Inc., Upper Saddle River, NJ (US)

( * ) Notice: Subject to any disclaimer, the term of this patent is extended or adjusted under 35 U.S.C. 154(b) by 0 days.

(21) Appl. No.: 11/803,276

(22) Filed: May 14, 2007

(65) Prior Publication Data

US 2008/0282648 A1 Nov. 20, 2008

(51) Int. Cl.
*B65B 61/00* (2006.01)
*B65B 53/02* (2006.01)

(52) U.S. Cl. ..... 53/415; 53/442; 53/449; 53/557; 53/175; 53/135.1; 53/136.3; 493/95; 493/100

(58) Field of Classification Search ..... 53/175, 53/442, 557, 449, 415, 135.1, 136.1, 136.3, 53/136.5; 493/95, 100; 229/164.2, 117.27, 229/117.33; 206/497
See application file for complete search history.

(56) References Cited

U.S. PATENT DOCUMENTS 2,065,182 A * 12/1936 Harris ..... 206/497
3,442,372 A * 5/1969 Carmichael et al. ..... 206/471
3,519,160 A * 7/1970 Poletika et al. ..... 217/3 BC
3,539,360 A * 11/1970 Wood ..... 229/117.33
4,328,896 A * 5/1982 Behne ..... 206/497
5,086,925 A * 2/1992 Coalier et al. ..... 206/497
6,216,871 B1 * 4/2001 Bacques et al. ..... 206/497
6,264,034 B1 * 7/2001 Bacques et al. ..... 206/497
6,676,011 B2 * 1/2004 Luu et al. ..... 229/117.33
6,880,313 B1 * 4/2005 Gessford et al. ..... 53/442
7,050,938 B1 * 5/2006 Prater et al. ..... 702/182
7,096,647 B2 8/2006 De Barbuat et al.
2002/0134052 A1 * 9/2002 Bernardo ..... 53/449
2003/0079443 A1 * 5/2003 Lindsey et al. ..... 53/442

FOREIGN PATENT DOCUMENTS

JP 52-37182 A * 3/1977

* cited by examiner

*Primary Examiner*—Stephen F Gerrity
(74) *Attorney, Agent, or Firm*—Day Pitney LLP

(57) ABSTRACT

The packaging method glues or otherwise secures a sheet of shrink wrap film to the bottom of a shipping package or carton. The sheet extends upward on both sides so as to be temporarily attached to the flaps of the shipping carton, typically by dots of glue. After the contents are placed in the shipping carton, the film is folded over the contents. Then a label, typically with a bar code, holds the film in place. The package is scanned to assure that the label is in place, and the package is exposed to a heat tunnel to shrink the shrink wrap film. The flaps of the carton are then sealed in a conventional way.

9 Claims, 3 Drawing Sheets

SHIPPING CONTAINER PACKING METHOD USING SHRINK WRAP

BACKGROUND OF THE INVENTION

1. Field of Invention

The present invention relates to a packaging method using shrink wrap. This method provides various simplifications as compared to prior art packaging methods.

2. Description of the Prior Art

U.S. Pat. No. 7,096,647 entitled "System for Packaging Products With Immobilization by Means of Shrink Wrap", issued on Aug. 29, 2006 to De Barbuat et al. provide a method for packaging products using shrink wrap. However, this method is unduly complicated and expensive and is therefore not applicable to present applications where simple and inexpensive packaging is required while maintaining the required reliability. Such packaging is required to reduce operating costs, thereby requiring automated equipment which is simple, inexpensive and reliable.

OBJECTS AND SUMMARY OF THE INVENTION

It is therefore an object of the present invention to provide a simple and inexpensive packaging method using a regular slotted carton (RSC) and shrink wrap.

It is therefore a further object of the present invention to provide a reliable packaging method.

These and other objects are attained by a method wherein a sheet of shrink wrap is glued or otherwise joined to the bottom of a cardboard box by several beads or dots of glue. Two opposing edges of the sheet of shrink wrap are releasably secured to the flaps of the lid of the cardboard box, typically by a single dot of glue on each opposing edge. After the contents, such as, but no limited to, books, are placed inside the box, the edges of the shrink wrap are released from the flaps of the lid of the cardboard box, and folded over the contents. A sticker, which typically includes a bar code, hold the edges of the film in place (typically overlapping each other) and the box is put into a heat tunnel, thereby shrinking the shrink wrap around the contents and securing the contents in place. The flaps are then folded down and taped.

DESCRIPTION OF THE DRAWINGS

Further objects and advantages of the invention will become apparent from the following description and from the accompanying drawings, wherein.

DETAILED DESCRIPTION OF THE PREFERRED EMBODIMENTS

Figure 6:
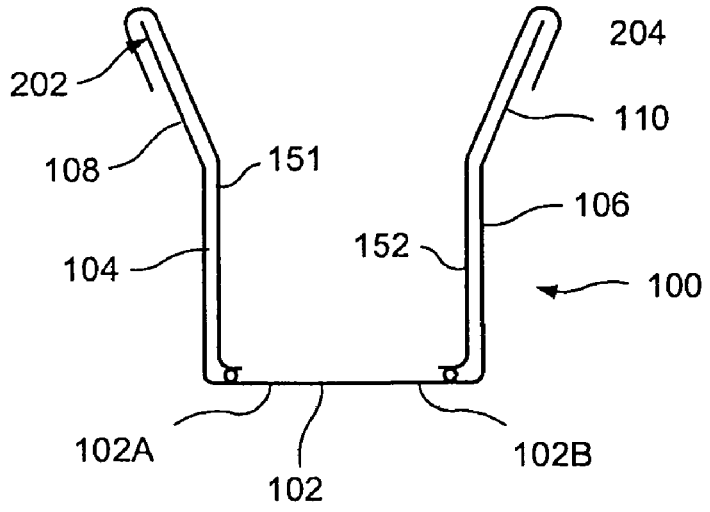
FIG. 6 is a cross-sectional view of an alternative to the embodiment shown in FIG. 1.

Referring now to the drawings in detail wherein like numerals indicate like elements throughout the several views, one sees that FIGS. 1-4 show the progression of the packaging method of the present invention, while FIG. 6 shows an alternative embodiment of the packaging method of the present invention.

At the outset, the packaging method of the present invention is typically preceded by a carton building process (see FIG. 5, block 702) wherein stacks of flat cartons of various sizes are loaded into automated carton building machines. The carton building machine grabs a flat carton and pops it open, folds the bottom overlapping flaps and tapes the bottom of the carton. The carton is released onto a take-away conveyor with the top flaps in the upward or unfolded position.

Figure 1:
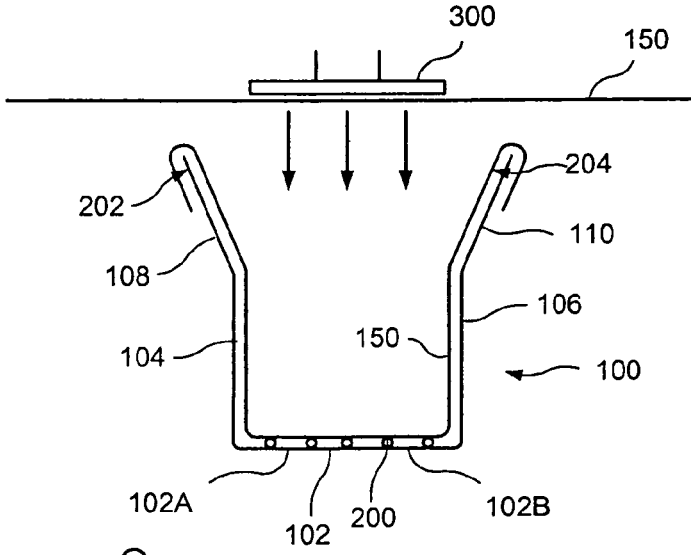
FIG. 1 is a cross-sectional view showing the sheet of film being placed in the package or carton.

As shown in FIG. 1, the carton 100 contains a bottom panel 102, comprised of folding panels 102A, 102B, which joins to the bottom edges of side panels 104, 106. Likewise, flaps 108, 110 are integral with the upper edges of side panels 104, 106. At a glue insertion station (see FIG. 5, block 704), primary glue injection heads plunge into the carton and coat the bottom panel 102 with hot melt glue 200 or similar adhesive material. Secondary glue injection heads apply dots of glue 202, 204 to respective flaps 108, 110.

The carton 100 is then released to the film insertion station (see FIG. 5, block 706) where a film inserter stretches shrink wrap film 150 across the top of the carton 100, cuts it to the preprogrammed length and overlaps both sides of the carton 100. The primary film plunger 300 then plunges into the carton and presses the film 150 against the hot melt glue 200. A secondary set of tamp heads presses the free ends of film 150 against the dots of glue 202, 204 on the exterior distal areas of flaps 108, 110 for a temporary attachment.

Figure 5:
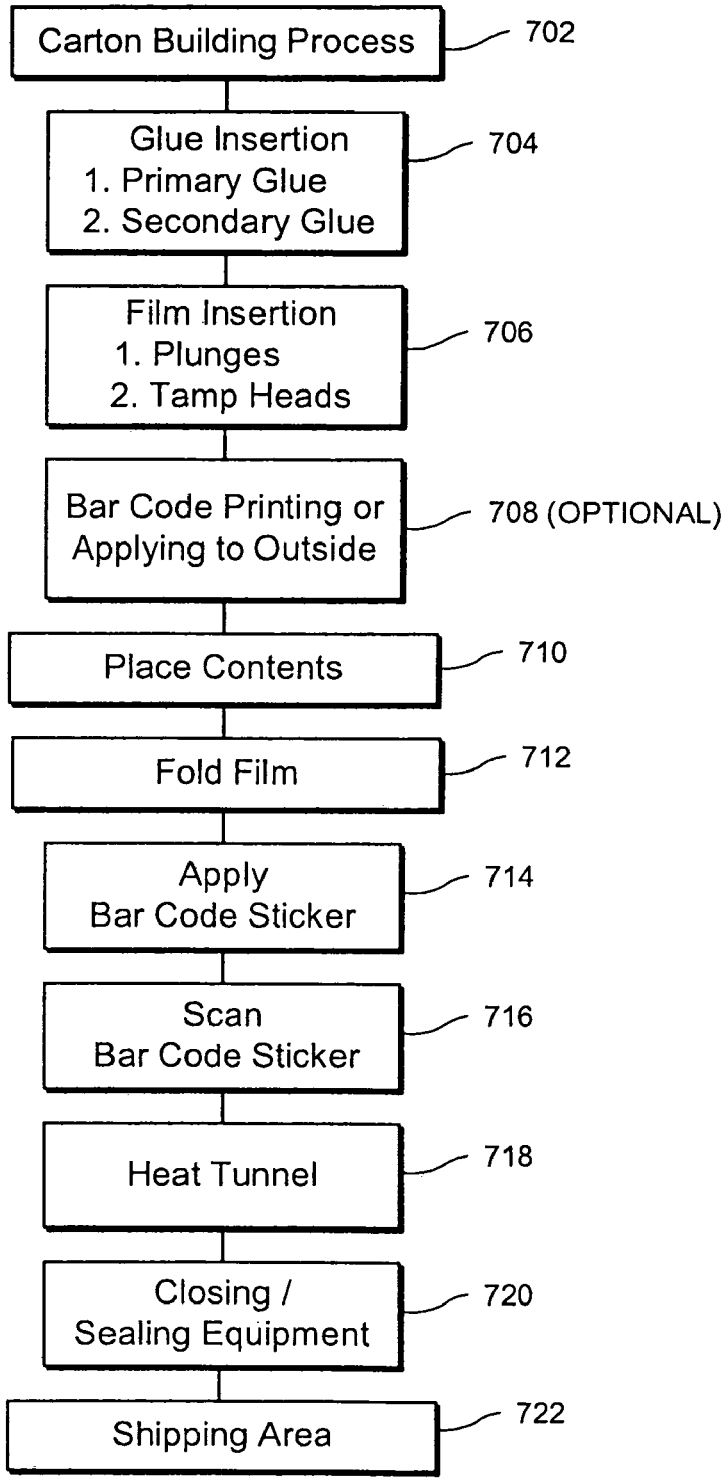
FIG. 5 is a schematic showing the sequence of steps of the packaging method.

Optionally, a bar code label 250 can then be applied or printed to the outside of the carton 100 (see FIG. 5, block 708).

Figure 2:
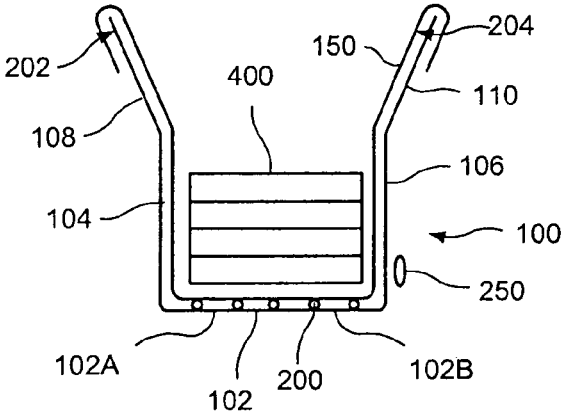
FIG. 2 is a cross-sectional view showing the contents, such as books, in the package or carton.
Figure 3:
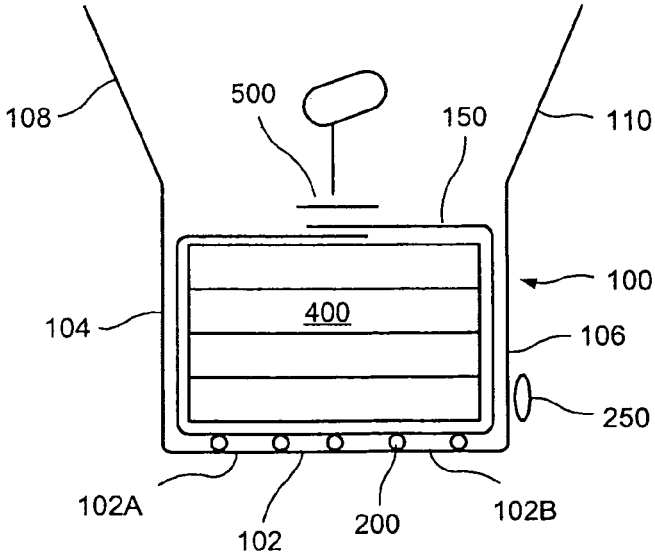
FIG. 3 is a cross-sectional view illustrating the heat tunnel which cause the shrinking of the film around the contents.

As shown in FIG. 2, the contents 400, such as, but not limited to, books, are placed in the carton 100 (see FIG. 5, block 710). As shown in FIG. 3, free ends of film 150 are released from flaps 108, 110 and folded over the contents 400 (see FIG. 5, block 712). A sticker 500, typically with a barcode (shown in area of detail) is applied to hold the film 150 in place (see FIG. 5, block 714). The carton 100, with the flaps 108, 110 still open, is then scanned to assure that the sticker or label 500 (typically including the barcode) is in place (see FIG. 5, block 716). If the sticker or label 500 is in place with the appropriate barcode, carton 100 is inducted into heat tunnel 100, shrinking the film 150 around the contents 400 (see FIG. 5, block 718).

Figure 4:
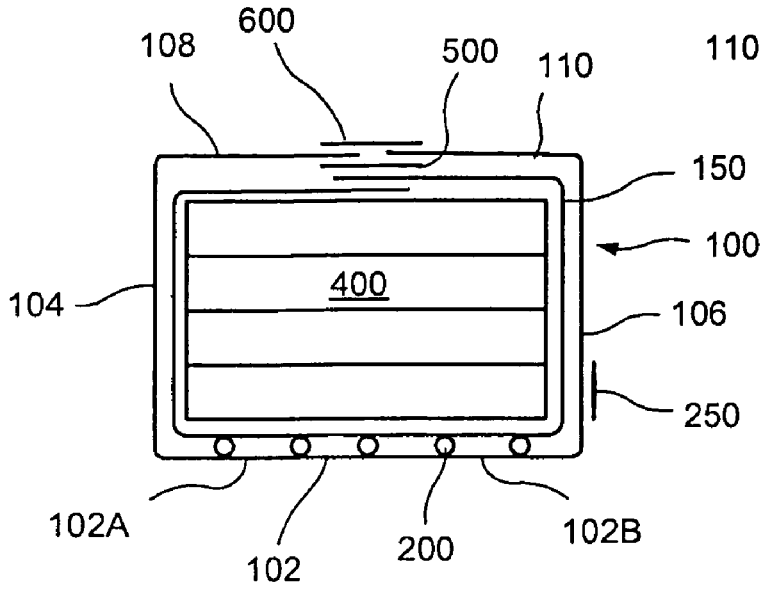
FIG. 4 is a cross-sectional view of the closed configuration of the package or carton.

The top flaps 108, 110 are then folded into a closed position and sealed or taped by tape 600 as shown in FIG. 4 (see FIG. 5, block 720). The carton 100 is then released to a shipping area (see FIG. 5, block 722).

FIG. 5 shows the sequence of stations for performing the steps of this process.

In FIG. 6, film segments 151, 152 are substituted for film 150 and the ends are glued to the portions of bottom panel 102 (comprised of folding panels 102A, 102B) immediately adjacent to side panels 104, 106.

Thus the several aforementioned objects and advantages are most effectively attained. Although preferred embodiments of the invention have been disclosed and described in detail herein, it should be understood that this invention is in no sense limited thereby and its scope is to be determined by that of the appended claims.

What is claimed is:

1. A method of packaging, comprising the steps of:

providing a shipping carton including flaps;

securing a portion of a sheet of wrapping material to a bottom of said shipping carton;

temporarily attaching free ends of said wrapping material to said flaps of said shipping container;

after said step of temporarily attaching free ends, placing contents into said shipping carton;

wrapping said free ends of said wrapping material around the contents;

securing said free ends of said wrapping material to one another by attaching a label including indicia to secure said free ends; and placing the shipping carton in a heating device to shrink said wrapping material around the contents.

2. The method of packaging of claim 1 wherein said wrapping material is shrink wrap material.

3. The method of packaging of claim 2 wherein said step of securing a portion of said sheet of wrapping material to said bottom of said shipping carton further comprises the steps of placing adhesive on said bottom of said shipping carton and placing said wrapping material in said adhesive.

4. The method of packaging of claim 3 wherein said adhesive is hot melt glue.

5. The method of packaging of claim 1 further including a step of releasing said free ends from said flaps, prior to said step of wrapping free ends and after said step of temporarily attaching.

6. The method of packaging of claim 1 wherein said label indicia includes a bar code.

7. The method of packaging of claim 6 further including the step of scanning said label prior to said step of placing said carton in a heating device.

8. The method of packaging of claim 7 wherein said step of placing said carton in a heating device is performed only if said step of scanning confirms the appropriate location of said label.

9. The method of packaging of claim 8 further including the step of closing said flaps of said carton and securing said flaps after said step of placing said carton in a heating device.

* * * * *